US011280195B2

(12) United States Patent
Zhang et al.

(10) Patent No.: US 11,280,195 B2
(45) Date of Patent: Mar. 22, 2022

(54) SINGLE-ANCHOR CENTRALLY GROUTED FULL-LENGTH ANCHORED STEEL WIRE BUNDLE AND SUPPORTING METHOD THEREOF

(71) Applicant: China University of Mining and Technology, Xuzhou (CN)

(72) Inventors: Nong Zhang, Xuzhou (CN); Zhengzheng Xie, Xuzhou (CN); Junyao Zhou, Xuzhou (CN); Qun Wei, Xuzhou (CN)

(73) Assignee: China University of Mining and Technology, Jiangsu (CN)

( * ) Notice: Subject to any disclaimer, the term of this patent is extended or adjusted under 35 U.S.C. 154(b) by 201 days.

(21) Appl. No.: 16/624,541

(22) PCT Filed: Oct. 29, 2018

(86) PCT No.: PCT/CN2018/112375
§ 371 (c)(1),
(2) Date: Dec. 19, 2019

(87) PCT Pub. No.: WO2020/037815
PCT Pub. Date: Feb. 27, 2020

(65) Prior Publication Data

US 2021/0340872 A1 Nov. 4, 2021

(30) Foreign Application Priority Data

Aug. 20, 2018 (CN) ..... 201810947765.4

(51) Int. Cl.
*E21D 21/00* (2006.01)
*E21D 20/02* (2006.01)

(52) U.S. Cl.
CPC ..... *E21D 20/026* (2013.01); *E21D 21/0006* (2013.01); *E21D 21/006* (2016.01)

(58) Field of Classification Search
CPC ..... E21D 21/006
See application file for complete search history.

(56) References Cited

U.S. PATENT DOCUMENTS 4,664,555 A * 5/1987 Herbst ..... E21D 21/006 405/259.5
6,189,281 B1 * 2/2001 Sobek ..... E02D 5/80 405/259.5

(Continued)

FOREIGN PATENT DOCUMENTS

CN 201507317 U 6/2010
CN 102828760 A 12/2012

(Continued)

OTHER PUBLICATIONS

International Search Report and Written Opinion for PCT/CN2018/112375 in Chinese, nine (9) pages, English translation not available.

(Continued)

*Primary Examiner* — Janine M Kreck
(74) *Attorney, Agent, or Firm* — Greenberg Traurig, LLP

(57) ABSTRACT

A single-anchor centrally grouted full-length anchored steel wire bundle and a supporting method thereof are described herein. The steel wire bundle consists of parallel steel wires and a central pipe, wherein multiple strands of parallel steel wires are arranged around the central pipe, the central pipe is provided with a slurry output bracket which divides the parallel steel wires into a front part and a rear part, the front part is provided with large stirring jackets, and the rear part is provided with a threaded casing on its tail end. After the coal is cut by a tunneling machine and a roadway is formed, the steel wire bundle is anchored at the ends, and the roadway tunneling speed is increased; central grouting is carried out for the steel wire bundle so as to anchor the steel wire bundle in full length and ensure long-time stability of the roadway.

9 Claims, 2 Drawing Sheets

(56) References Cited

U.S. PATENT DOCUMENTS

| | | | | |
|---|---|---|---|---|
| 6,428,243 | B1 * | 8/2002 | Hutchins | E21D 20/02 405/259.1 |
| 2004/0136788 | A1 * | 7/2004 | Hindle | F16B 13/0833 405/259.1 |

FOREIGN PATENT DOCUMENTS

| | | | |
|---|---|---|---|
| CN | 102852144 | A | 1/2013 |
| CN | 103898904 | A | 7/2014 |
| CN | 105221171 | A | 1/2016 |
| CN | 205206857 | U | 5/2016 |
| CN | 207261029 | U | 4/2018 |
| DE | 3532070 | A1 | 3/1987 |

OTHER PUBLICATIONS

English translation of International Search Report for International Application No. PCT/CN2018/112375, dated Feb. 27, 2019.

* cited by examiner

SINGLE-ANCHOR CENTRALLY GROUTED FULL-LENGTH ANCHORED STEEL WIRE BUNDLE AND SUPPORTING METHOD THEREOF

CROSS REFERENCE TO RELATED APPLICATIONS

The present application is a 371 U.S. National Stage of International Application No. PCT/CN2018/0112375, filed Oct. 29, 2018, entitled "A SINGLE-ANCHOR CENTRALLY GROUTED FULL-LENGTH ANCHORED STEEL WIRE BUNDLE AND SUPPORTING METHOD THEREOF" which in turn claims priority to Chinese Application 201810947765.4 with the same title filed Aug. 20, 2018, both of which are incorporated herein by reference in their entirety.

TECHNICAL FIELD

Various embodiments described herein are related to a single-anchor centrally grouted full-length anchored steel wire bundle and a supporting method thereof, which are especially suitable for use in the supporting engineering for the deep dynamic pressure roadway or soft rock roadway.

BACKGROUND

As large quantities of coal resources have been exploited, shallow coal resources cannot meet the need for national development. In order to realize sustainable development of the coal industry, deep mining has become a major subject that must be solved in the coal industry.

For the deep roadway, it will be affected by greater ground stress. After a roadway is excavated, large stress concentration may occur and large deformation of the roadway is a prominent problem since the original stress balance in the surrounding rock is broken. Besides, in a roadway with secondary dynamic pressure, the roadway is affected by twice mining operations at the working face, and the roadway deformation problem is especially prominent. In the existing anchor rod-rope supporting systems, the anchor rods are too short to control the deformation of deep surrounding rock; the anchor ropes are too long to provide effective support within their ranges, so that the problem of large deformation of the roadway cannot be solved; moreover, the alternative construction of anchor rods and anchor ropes severely restricts the improvement of the roadway tunneling speed and the mining imbalance of the mine becomes more prominent. Therefore, it is urgent to develop a novel supporting material and a supporting method thereof, which can control the deformation of surrounding rock in deep roadway and meet the requirement for quick roadway tunneling as well.

Figure 1:
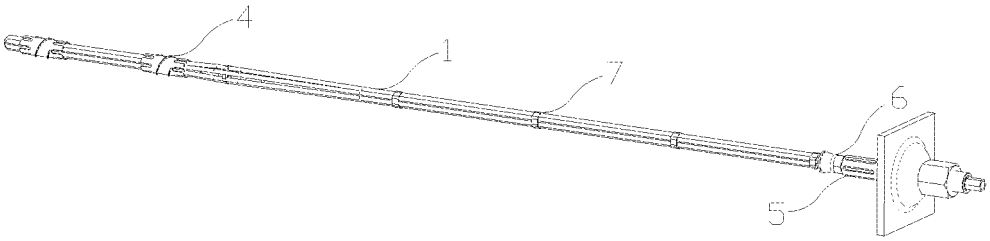
FIG. 1 is a schematic view of the steel wire bundle according various embodiments.

In the figures: 1—multiple parallel steel wires; 2—central pipe; 2-1—steel pipe; 2-2—plastic hose; 2-3—barb; 3—slurry output bracket; 3-1—pressure bearing body; 3-2—limit groove; 3-3—slurry outlet; 3-4—interface; 4—large stirring jacket; 4-1—welding groove I; 4-2—thread; 5—threaded casing; 5-1—welding groove II; 5-2—thread; 6—slurry stop plug; and 7—clamp.

DETAILED DESCRIPTION

Technical Problem in view of the above-mentioned drawbacks in the prior art, the various embodiments described herein provide a single-anchor centrally grouted full-length anchored steel wire bundle and a supporting method thereof, wherein, the requirement for length is met, the rod body is under uniform stress, the installation is easy and the cost is low.

Technical Scheme to attain the above technical objects, a single-anchor centrally grouted full-length anchored steel wire bundle provided in the various embodiments described herein provide a main body of steel wire bundle and a tray and a nut arranged on a tail end of the main body of steel wire bundle, the main body of steel wire bundle comprises a central pipe and multiple strands of parallel steel wires which are arranged in parallel around the central pipe and in the same length as the central pipe, the central pipe is provided with a slurry output bracket which divides the main body of steel wire bundle into a front part and a rear part, the front part of the main body of steel wire bundle is provided with a plurality of large stirring jackets, the rear part of the main body of steel wire bundle is provided with a plurality of clamps at intervals, a threaded casing is provided on the tail end of the rear part of the main body of steel wire bundle, a slurry stop plug is provided on the main body of steel wire bundle at the front end of the threaded casing, the threaded casing is divided into a front part and a rear part, the front part of the threaded casing is provided with a plurality of welding grooves II, the rear part of the threaded casing is provided with threads on the outside, and the tray and the nut are arranged on the threads.

The central pipe is hollow and comprises a steel pipe and a plastic hose, the plastic hose is arranged at the front end, the steel pipe is arranged at the rear end, the threaded casing and the slurry stop plug are arranged outside the main body of steel wire bundle at the steel pipe, the central pipe in the remaining part of the main body of steel wire bundle is the plastic hose, barbs are arranged in the interior of a port of the plastic hose, the plastic hose is connected with the steel pipe via the barbs, the central pipe has a wall thickness of 1.5 mm~2.5 mm and a length of 3,000 mm~4,000 mm, the steel pipe has a length of 400 mm~600 mm, the plastic hose has a length of 2,500 mm~3,500 mm, and the steel pipe is connected with the plastic hose via the barbs so that the central pipe is sealed at the joint.

The slurry output bracket comprises a hollow spindle-shaped pressure bearing body, U-shaped limit grooves matching the number and diameter of the parallel steel wires and a plurality of slurry outlets connected with the interior of the central pipe are arranged on the thickest part of a middle section of the pressure bearing body, the tail end of the pressure bearing body is provided with an interface for connection with the central pipe, the parallel steel wires fix the slurry output bracket by means of the limit grooves, the surfaces of the spindle-shaped pressure bearing body are fitted to the parallel steel wires, the bottom of the limit groove has a diameter of 5 mm~9 mm at the position where the steel wire is fixed, the slurry outlets and the limit grooves are arranged in misalignment, the slurry outlets has a diameter of 3 mm~6 mm for discharge of the slurry, and the plurality of slurry outlets decrease the probability of grouting failure resulted from clogging of the slurry outlets.

The large stirring jacket is a hollow tubular structure and have a plurality of welding grooves I on both ends respectively, the welding grooves on the front end and the rear end of the large stirring jacket are located at the grooves between two parallel steel wires, stirring threads with the height of 5 mm and the thickness of 1 mm are arranged on the middle part of the large stirring jacket to facilitate stirring of an anchoring agent.

There are 6 strands of parallel steel wires, which are made of cold-drawn low-carbon steel wires with the diameter of 4 mm~8 mm and the length of 3,000 mm~4,000 mm. The welding groove of the threaded casing is located at the groove between two parallel steel wires, and has threads on the tail part, and the inner diameter of the threaded casing is 12-24 mm. The slurry stop plug is a rubber product in a horn shape, the inner diameter of a narrower opening of which is 12-24 mm, the inner diameter of a wider opening of which is 15-30 mm and the wall thickness of which is 2 mm, for sealing the slurry and preventing the slurry from flowing out of the hole. The clamps have a width of 8 mm and a thickness of 1 mm for fastening the steel wire bundle, and the number of the clamps is determined according to the length of the steel wire bundle.

A single-anchor centrally grouting full-length anchoring supporting method using a single-anchor centrally grouted full-length anchored steel wire bundle, comprising the following steps:

a. after cutting the coal with a tunneling machine, drilling an anchor rod borehole in the roadway roof with a jumbolter, wherein the length of the borehole is 100 mm~150 mm smaller than the length of anchor rod;

b. putting a resin cartridge into the borehole and then the steel wire bundle, screwing the steel wire bundle into the borehole with the jumbolter, and utilizing the large stirring jacket at the front end of the steel wire bundle to stir the resin cartridge thoroughly to enhance the cohesion force between the resin cartridge and the roof strata;

c. mounting a slurry stop plug, a tray and a nut on the tail end of the steel wire bundle sequentially, then applying pre-tightening force to the steel wire bundle; thus, the anchoring work of the ends of the steel wire bundle is finished;

d. subsequently, performing central grouting for the steel wire bundle with a mobile pump truck without affecting quick tunneling of the working face; connecting a plurality of grouting pipes on the mobile pump truck to the central pipe in the steel wire bundle and starting grouting, so that the slurry flows through the central pipe via the grouting pipes and flows out of the slurry outlets of the slurry output bracket, after the entire borehole is fully filled with the slurry, loading the grouting pressure to 2 MPa and maintaining the grouting pressure for 5 min, then stopping the grouting and waiting for curing; thus, the steel wire bundle is anchored in full length so that the multiple strands of parallel steel wires form an organic whole and bear the stress uniformly when the rock mass deforms, and thereby the problem of large deformation and instability of the roadway is solved.

Benefits: with the above-mentioned technical solution, the various embodiments described herein have one or more of the following advantages over the prior art:

1) The steel wire bundle comprises 6 parallel steel wires, which bear the stress uniformly under working load, thereby avoiding stress concentration in the rod body of the steel wire bundle, reducing potential safety hazard and improving the safety factor of roadway supporting;

2) The steel wire bundle is made of flexible material, and the length of the steel wire bundle may be selected according to the geologic condition and the mining environment of the mine, and is not limited by the dimensions of the cross section of the roadway;

3) A plurality of large stirring jackets are provided at the front end of the steel wire bundle to stir the resin cartridge thoroughly, thereby enhancing the anchoring effect and avoiding anchoring failures.

4) The tail end of the steel wire bundle is provided with a threaded casing, and pre-tightening force can be applied via the threaded casing in the mounting process of the steel wire bundle; thus, the mounting is more convenient, and the working efficiency is improved;

5) The roof is supported solely by means of steel wire bundles; thus, the drawbacks of alternative construction with anchor rods and anchor ropes are avoided, the construction procedures are simplified, the roadway tunneling speed is increased, and safe and efficient production in the mine can be realized;

6) In the construction process, the ends of the steel wire bundle are anchored first, then central grouting is carried out for the steel wire bundle with a mobile pump truck to realize full-length anchoring without affecting the quick tunneling of the working face, thereby a thick anchoring rock beam for the roof can be formed, the problem of large deformation of a deep roadway can be solved, and the stability of the surrounding rock of the roadway is ensured; besides, since the later-stage central grouting for the steel wire bundle does not affect the normal construction at the working face, the tunneling speed is further improved, and mining imbalance in the mine is relieved greatly.

Hereunder example embodiments will be further described with reference to the drawings.

Figure 2:
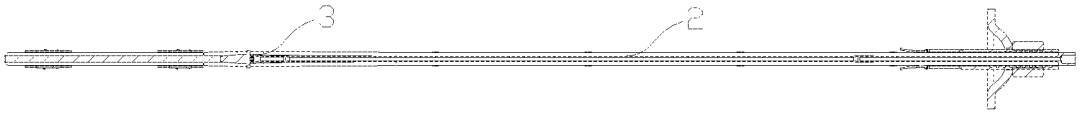
FIG. 2 is a sectional view of the steel wire bundle according to the present invention.
Figure 3:
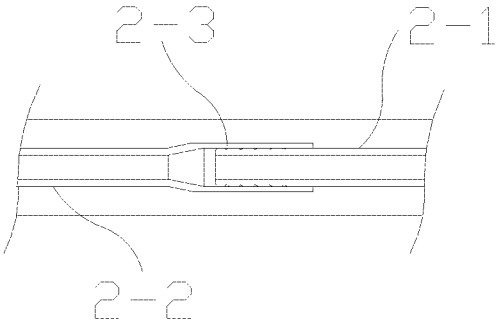
FIG. 3 is a sectional view of the central pipe according to the present invention.
Figure 4:
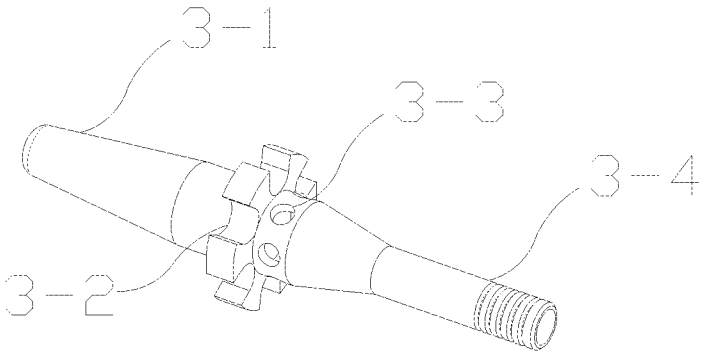
FIG. 4 is a schematic view of the slurry output bracket according to the present invention.
Figure 5:
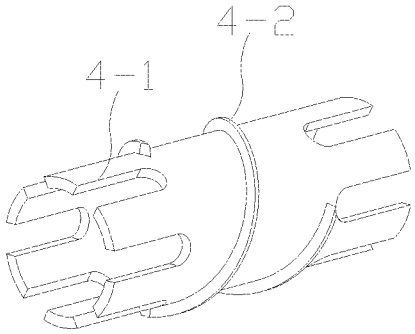
FIG. 5 is a schematic view of the large stirring jacket according to the present invention.
Figure 6:
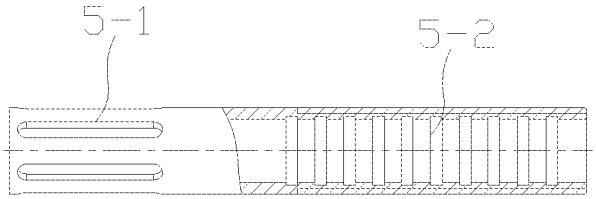
FIG. 6 is a schematic view of the threaded casing according to the present invention.
Figure 7:
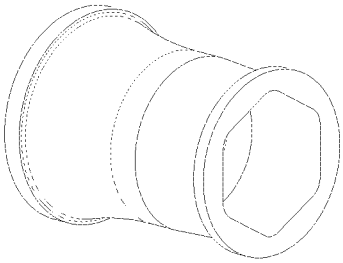
FIG. 7 is a schematic view of the slurry stop plug according to the present invention.

As shown in FIGS. 1 and 2, a single-anchor centrally grouted full-length anchored steel wire bundle provided in the present embodiment comprises a main body of steel wire bundle and a tray and a nut arranged on a tail end of the main body of steel wire bundle, the main body of steel wire bundle comprises a central pipe 2, the central pipe 2 is hollow and comprises a steel pipe 2-1 and a plastic hose 2-2, the plastic hose 2-2 is arranged at the front end, the steel pipe 2-1 is arranged at the rear end, the threaded casing 5 and the slurry stop plug are arranged outside the main body of steel wire bundle at the steel pipe 2-1, the central pipe 2 in the remaining part of the main body of steel wire bundle is the plastic hose 2-2, as shown in FIG. 3, barbs 2-3 are arranged in the interior of a port of the plastic hose 2-2, the plastic hose 2-2 is connected with the steel pipe 2-1 via the barbs 2-3, the central pipe 2 has a wall thickness of 1.5 mm~2.5 mm and a length of 3,000 mm~4,000 mm, the steel pipe 2-1 has a length of 400 mm~600 mm, the plastic hose 2-2 has a length of 2,500 mm~3,500 mm, and the steel pipe 2-1 is connected with the plastic hose 2-2 via the barbs so that the central pipe is sealed at the joint; multiple strands of parallel steel wires 1 are arranged in parallel around the central pipe 2, there are 6 strands of parallel steel wires 1, which are made of cold-drawn low-carbon steel wires with the diameter of 4 mm~8 mm and the length of 3,000 mm~4,000 mm, the parallel steel wires 1 are of the same length as the central pipe 2, the central pipe 2 is provided with a slurry output bracket 3 which divides the main body of steel wire bundle into a front part and a rear part as shown in FIG. 4, the slurry output bracket 3 comprises a hollow spindle-shaped pressure bearing body 3-1, U-shaped limit grooves 3-2 matching the number and diameter of the parallel steel wires 1 and a plurality of slurry outlets 3-3 connected with the interior of the central pipe 2 are arranged on the thickest part of a middle section of the pressure bearing body 3-1, the tail end of the pressure bearing body 3-1 is provided with an interface 3-4 for connection with the central pipe 2, the parallel steel wires 1 fix the slurry output bracket 3 by means of the limit grooves 3-2, the surfaces of the spindle-shaped pressure bearing body 3-1 are fitted to the parallel steel wires 1, the bottom of the limit groove 3-2 has a diameter of 5 mm~9 mm at the position where the steel wire is fixed, the slurry outlets 3-3 and the limit grooves 3-2 are arranged in misalignment, the slurry outlets 3-3 has a diameter of 3 mm~6 mm for discharge of the slurry, and the plurality of slurry outlets 3-3 decrease the probability of grouting failure resulted from clogging of the slurry outlets;

As shown in FIG. 5, the front part of the main body of steel wire bundle is provided with a plurality of large stirring jackets 4, the large stirring jacket 4 is a hollow tubular structure and have a plurality of welding grooves I 4-1 on both ends respectively, the welding grooves on the front end and the rear end of the large stirring jacket 4 are located at the grooves between two parallel steel wires, stirring threads 4-2 with the height of 5 mm and the thickness of 1 mm are arranged on the middle part of the large stirring jacket to facilitate stirring of an anchoring agent, the rear part of the main body of steel wire bundle is provided with a plurality of clamps 7 at intervals, the clamps 7 have a width of 8 mm and a thickness of 1 mm for fastening the steel wire bundle, and the number of the clamps 7 is determined according to the length of the steel wire bundle;

As shown in FIG. 6, a threaded casing 5 is provided on the tail end of the rear part of the main body of steel wire bundle, a slurry stop plug is provided on the main body of steel wire bundle at the front end of the threaded casing 5, the threaded casing 5 is divided into a front part and a rear part, the front part of the threaded casing 5 is provided with a plurality of welding grooves II 5-1, the rear part of the threaded casing 5 is provided with threads 5-2 on the outside, and the tray and the nut are arranged on the threads 5-2, the welding groove 5-1 of the threaded casing 5 is located at the groove between two parallel steel wires 1, and has threads 5-2 on the tail part, and the inner diameter of the threaded casing 5 is 12-24 mm, as shown in FIG. 7, the slurry stop plug 6 is a rubber product in a horn shape, the inner diameter of a narrower opening of which is 12-24 mm, the inner diameter of a wider opening of which is 15-30 mm and the wall thickness of which is 2 mm, for sealing the slurry and preventing the slurry from flowing out of the hole.

A single-anchor centrally grouting full-length anchoring supporting method using the single-anchor centrally grouted full-length anchored steel wire bundle, wherein, it comprises the following steps:

a. after cutting the coal with a tunneling machine, drilling an anchor rod borehole in the roadway roof with a jumbolter, wherein the length of the borehole is 100 mm~150 mm smaller than the length of anchor rod;

b. putting a resin cartridge into the borehole and then the steel wire bundle, screwing the steel wire bundle into the borehole with the jumbolter, and utilizing the large stirring jacket 4 at the front end of the steel wire bundle to stir the resin cartridge thoroughly to enhance the cohesion force between the resin cartridge and the roof strata;

c. mounting a slurry stop plug 6, a tray and a nut on the tail end of the steel wire bundle sequentially, then applying pre-tightening force to the steel wire bundle; thus, the anchoring work of the ends of the steel wire bundle is finished;

d. subsequently, performing central grouting for the steel wire bundle with a mobile pump truck without affecting quick tunneling of the working face; connecting a plurality of grouting pipes on the mobile pump truck to the central pipe 2 in the steel wire bundle and starting grouting, so that the slurry flows through the central pipe 2 via the grouting pipes and flows out of the slurry outlets of the slurry output bracket 4, after the entire borehole is fully filled with the slurry, loading the grouting pressure to 2 MPa and maintaining the grouting pressure for 5 min, then stopping the grouting and waiting for curing; thus, the steel wire bundle is anchored in full length so that the multiple strands of parallel steel wires form an organic whole and bear the stress uniformly when the rock mass deforms, and thereby the problem of large deformation and instability of the roadway is solved.

A single-anchor centrally grouted full-length anchored steel wire bundle and a supporting method thereof, which are suitable for use in supporting engineering for the deep dynamic pressure roadway or soft rock roadway. The steel wire bundle consists of parallel steel wires and a central pipe, wherein multiple strands of parallel steel wires are arranged around the central pipe, the central pipe is provided with a slurry output bracket which divides the parallel steel wires into a front part and a rear part, the front part is provided with large stirring jackets, and the rear part is provided with a threaded casing on its tail end. After the coal is cut by a tunneling machine and a roadway is formed, the steel wire bundle is anchored at the ends, and the roadway tunneling speed is increased on a premise of ensuring roadway safety; central grouting is carried out for the steel wire bundle with a pump truck without affecting the quick roadway tunneling, so as to anchor the steel wire bundle in full length and ensure long-time stability of the roadway. The length of the steel wire bundle may be selected according to the geological conditions and the mining environment of the mine, and is not limited by the height of the roadway; the single-anchor centrally grouted supporting method realizes full-length anchoring of the steel wire bundle, and it not only improves the roadway tunneling speed and relieves mining imbalance in the mine, but also solves the problem of large deformation of the roadway.

The invention claimed is:

1. A single-anchor centrally grouted full-length anchored steel wire bundle, comprising a main body of steel wire bundle and a tray and a nut arranged on a tail end of the main body of steel wire bundle, wherein, the main body of steel wire bundle comprises a central pipe and multiple strands of parallel steel wires which are arranged in parallel around the central pipe and in the same length as the central pipe, the central pipe is provided with a slurry output bracket which divides the main body of steel wire bundle into a front part and a rear part, the front part of the main body of steel wire bundle is provided with a large stirring jacket, the rear part of the main body of steel wire bundle is provided with a plurality of clamps at intervals, a threaded casing is provided on the tail end of the rear part of the main body of steel wire bundle, a slurry stop plug is provided on the main body of steel wire bundle at the front end of the threaded casing, the threaded casing is divided into a front part and a rear part, the front part of the threaded casing is provided with a plurality of first welding grooves, the rear part of the threaded casing is provided with threads on the outside, and the tray and the nut are arranged on the threads.

2. The single-anchor centrally grouted full-length anchored steel wire bundle according to claim 1, wherein, the central pipe is hollow and comprises a steel pipe and a plastic hose, the plastic hose is arranged at the front end, the steel pipe is arranged at the rear end, the threaded casing and the slurry stop plug are arranged outside the main body of steel wire bundle at the steel pipe, the central pipe in the remaining part of the main body of steel wire bundle is the plastic hose, barbs are arranged in the interior of a port of the plastic hose, the plastic hose is connected with the steel pipe-via the barbs, the central pipe has a wall thickness of 1.5 millimeter (mm)-2.5 mm and a length of 3,000 mm-4,000 mm, the steel pipe has a length of 400 mm-600 mm, the plastic hose has a length of 2,500 mm-3,500 mm, and the steel pipe is connected with the plastic hose-via the barbs so that the central pipe is sealed at the joint.

3. The single-anchor centrally grouted full-length anchored steel wire bundle according to claim 1, wherein, the slurry output bracket comprises a hollow spindle-shaped pressure bearing body, U-shaped limit grooves matching the number and diameter of the parallel steel wires and a plurality of slurry outlets connected with the interior of the central pipe are arranged on the thickest part of a middle section of the pressure bearing body, the tail end of the pressure bearing body is provided with an interface for connection with the central pipe, the parallel steel wires fix the slurry output bracket by means of the limit grooves, the surfaces of the spindle-shaped pressure bearing body are fitted to the parallel steel wires, the bottom of the limit groove has a diameter of 5 millimeter (mm)-9 mm at the position where the steel wire is fixed, the slurry outlets and the limit grooves are arranged in misalignment, the slurry outlets has a diameter of 3 mm-6 mm for discharge of the slurry, and the plurality of slurry outlets decrease the probability of grouting failure resulted from clogging of the slurry outlets.

4. The single-anchor centrally grouted full-length anchored steel wire bundle according to claim 1, wherein, the large stirring jacket is a hollow tubular structure and have a plurality of second welding grooves on both ends respectively, the second welding grooves on the front end and the rear end of the large stirring jacket are located at the grooves between two parallel steel wires, stirring threads with the height of 5 millimeter (mm) and the thickness of 1 mm are arranged on the middle part of the large stirring jacket to facilitate stirring of an anchoring agent.

5. The single-anchor centrally grouted full-length anchored steel wire bundle according to claim 1, wherein, there are 6 strands of parallel steel wires, which are made of cold-drawn low-carbon steel wires with the diameter of 4 millimeter (mm)-8 mm and the length of 3,000 mm-4,000 mm.

6. The single-anchor centrally grouted full-length anchored steel wire bundle according to claim 1, wherein, the first welding groove of the threaded casing is located at the groove between two parallel steel wires, and the tail end of the threaded casing is provided with threads, and the inner diameter of the threaded casing is 12-24 millimeter (mm).

7. The single-anchor centrally grouted full-length anchored steel wire bundle according to claim 1, wherein, the slurry stop plug is a rubber product in a horn shape, the inner diameter of a narrower opening of which is 12-24 millimeter (mm), the inner diameter of a wider opening of which is 15-30 mm and the wall thickness of which is 2 mm, for sealing the slurry and preventing the slurry from flowing out of a hole.

8. The single-anchor centrally grouted full-length anchored steel wire bundle according to claim 1, wherein, the clamps have a width of 8 millimeter (mm) and a thickness of 1 mm for fastening the steel wire bundle, and the number of the clamps is determined according to the length of the steel wire bundle.

9. A supporting method using the single-anchor centrally grouted full-length anchored steel wire bundle according to claim 1, wherein, it comprises the following steps:

after cutting coal with a tunneling machine, drilling a borehole in the roadway roof with an anchor rod of a jumbolter, wherein the length of the borehole is 100 millimeter (mm) 150 mm smaller than the length of the anchor rod;

putting a resin cartridge into the borehole and then the steel wire bundle, screwing the steel wire bundle into the borehole with the jumbolter, and utilizing the large stirring jacket at the front end of the steel wire bundle to stir the resin cartridge thoroughly to enhance the cohesion force between the resin cartridge and the roof strata;

mounting the slurry stop plug, the tray and the nut on the tail end of the steel wire bundle sequentially, then applying pre-tightening force to the steel wire bundle; thus, the anchoring work of the ends of the steel wire bundle is finished; and subsequently, performing central grouting for the steel wire bundle with a mobile pump truck without affecting quick tunneling of the working face; connecting a plurality of grouting pipes on the mobile pump truck to the central pipe in the steel wire bundle and starting grouting, so that the slurry flows through the central pipe via the grouting pipes and flows out of a plurality of slurry outlets of the slurry output bracket after the entire borehole is fully filled with the slurry, loading the grouting pressure to 2 Megapascals (MPa) and maintaining the grouting pressure for 5 minutes, then stopping the grouting and waiting for curing; thus, the steel wire bundle is anchored in full length so that the multiple strands of parallel steel wires form an organic whole and bear the stress uniformly when the rock mass deforms, and thereby the problem of large deformation and instability of the roadway is solved.

* * * * *